US006396220B1

(12) United States Patent
Delia et al.

(10) Patent No.: US 6,396,220 B1
(45) Date of Patent: May 28, 2002

(54) LAMP IGNITION WITH COMPENSATION FOR PARASITIC LOADING CAPACITANCE

(75) Inventors: Vincent J. Delia, Chicago, IL (US); James A. Kocur, Dyer, IN (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/850,544

(22) Filed: May 7, 2001

(51) Int. Cl.[7] ..... G05F 1/00

(52) U.S. Cl. ..... 315/291; 315/209 CD; 315/240; 315/244; 315/276; 315/283; 315/362; 315/DIG. 5

(58) Field of Search ..... 315/291, 119, 315/127, 224, 209 CD, 240, 244, 243, 276, 283, 289, 307, 362, DIG. 2, DIG. 5

(56) References Cited

U.S. PATENT DOCUMENTS 3,978,368 A * 8/1976 Tomura et al. ..... 315/101
4,079,292 A * 3/1978 Kaneda ..... 315/105
5,051,660 A * 9/1991 Domann et al. ..... 315/219
5,070,276 A * 12/1991 Burgholte et al. ..... 315/205
5,493,182 A * 2/1996 Sowa et al. ..... 315/291
5,825,139 A 10/1998 Nuckolls et al. ..... 315/307
5,828,186 A 10/1998 Slegers et al. ..... 315/290
6,144,171 A 11/2000 Clements et al. ..... 315/289

* cited by examiner

*Primary Examiner*—Don Wong
*Assistant Examiner*—Thuy Vinh Tran

(57) ABSTRACT

A ballast for powering a gaseous discharge lamp that has a required minimum ignition voltage and a permissible maximum ignition voltage. Via a cable through which ignition voltage pulses are delivered to the lamp. The ballast has a first state of operation wherein a first reactive energy source charges parasitic loading capacitance of the cable to a voltage that does not exceed the permissible maximum voltage of the lamp when the parasitic loading capacitance of the cable is within a first predetermined range of capacitances. The ballast has a second state of operation wherein the second reactive energy source charges the parasitic loading capacitance of the cable to at least the required minimum ignition voltage of the lamp when the parasitic capacitance of the cable is within a second predetermined range of capacitances.

13 Claims, 6 Drawing Sheets

LAMP IGNITION WITH COMPENSATION FOR PARASITIC LOADING CAPACITANCE

BACKGROUND OF THE INVENTION

1. Field of the Invention

This invention relates to gaseous discharge lamps which ignite at voltages that are much higher than their operating voltages and, in particular, to the igniting of such lamps.

2. Description of Related Art

Common characteristics of a gaseous discharge lamp are its negative resistance and high igniting voltage. Circuitry for powering such a lamp typically includes a current limiting means, such as a ballast, to compensate for the negative resistance, and often includes igniter circuitry for generating high-voltage pulses to ignite the lamps. Such igniter circuitry commonly includes a voltage-sensitive switch (e.g. a sidac) for effecting the continual production of the high-voltage pulses until the lamp ignites. Upon ignition, the voltage across the lamp decreases from a higher open-circuit voltage (OCV) to a lower voltage, which causes the switch to change to a nonconducting state and to effect termination of pulse production. One example of such a ballast is described in U.S. Pat. No. 5,825,139.

Typically, a cable separates the igniter circuit from the gaseous discharge lamp. The distance between gaseous discharge lamp and the ballast is typically referred to the "BTL" distance, i.e. the ballast-to-lamp distance. As the BTL distance increases, the loading effect of parasitic capacitances associated with the cable increases thereby degrading the igniter voltage pulse actually delivered to the lamp. The parasitic loading capacitance is directly proportional to the BTL distance. Typically, for significant BTL distances, the igniter voltage pulse actually applied to the lamp does not even meet the minimum ANSI specifications. Thus, without any compensation, the peak voltage delivered to the lamp would tend to decrease with increases in parasitic loading capacitance.

One attempt to address the aforementioned problem is to configure the ignitor so as to increase its output voltage. As a result, when the BTL distance is relatively long, the resulting magnitude of the igniter voltage pulse applied to the lamp complies with ANSI specifications and is sufficient to properly illuminate the lamp. However, such a high-output igniter circuit is not suitable for use when the BTL distance is relatively short. In such a situation, the relatively high magnitude of the igniter voltage pulse is far greater than the maximum ANSI specifications. The application of such a high-magnitude ignitor pulse to the lamp usually reduces the life of the lamp and may even cause damage to the lamp and other ballast components.

What is needed is a single igniter circuit that can be used for both relatively short or long BTL distances.

SUMMARY OF THE INVENTION

In accordance with the invention, circuitry is provided for powering a gaseous discharge lamp that has a required minimum ignition voltage and a permissible maximum ignition voltage. The circuitry comprises an output configured for connection to a cable through which ignition voltage pulses are delivered to the lamp wherein the cable has a predetermined parasitic loading capacitance that depends upon the length of the cable and wherein the predetermined parasitic loading capacitance is within a range of parasitic loading capacitances defined by a predetermined minimum capacitance and a predetermined maximum capacitance. The circuitry further comprises a source of ignition pulses including an energy source capable of outputting an ignition voltage into a cable that has the predetermined maximum parasitic loading capacitance and charging that predetermined maximum parasitic loading capacitance to at least the required minimum ignition voltage of the lamp. The energy source comprises a first energy source and a second energy source. The source of ignition pulses has a first state of operation wherein the first energy source charges the parasitic loading capacitance of the cable to a voltage that does not exceed the permissible maximum voltage of the lamp when the parasitic loading capacitance of the cable is within a first predetermined range of capacitances. The source of ignition pulses has a second state of operation wherein the second energy source charges the parasitic loading capacitance of the cable to at least the required minimum ignition voltage of the lamp when the parasitic capacitance of the cable is within a second predetermined range of capacitances. Each capacitance of the second range is larger than every capacitance of the first range.

In one embodiment, the first and second energy sources each comprise a capacitive source.

A key feature of the present invention is that the reactive storage capacity of a ballast is varied to compensate for the particular parasitic loading capacitances associated with a cable that delivers the ignition voltage to the lamp. Thus, the peak voltage delivered to the lamp does not exceed the permissible maximum voltage when the cable is relatively short, and does not fall below a required minimum voltage when the cable is relatively long.

An advantage of the present invention is that such compensation for the parasitic loading capacitances of the cable are achieved without substantially increasing the cost or complexity of the ballast.

DESCRIPTION OF THE PREFERRED EMBODIMENTS

Figure 1:
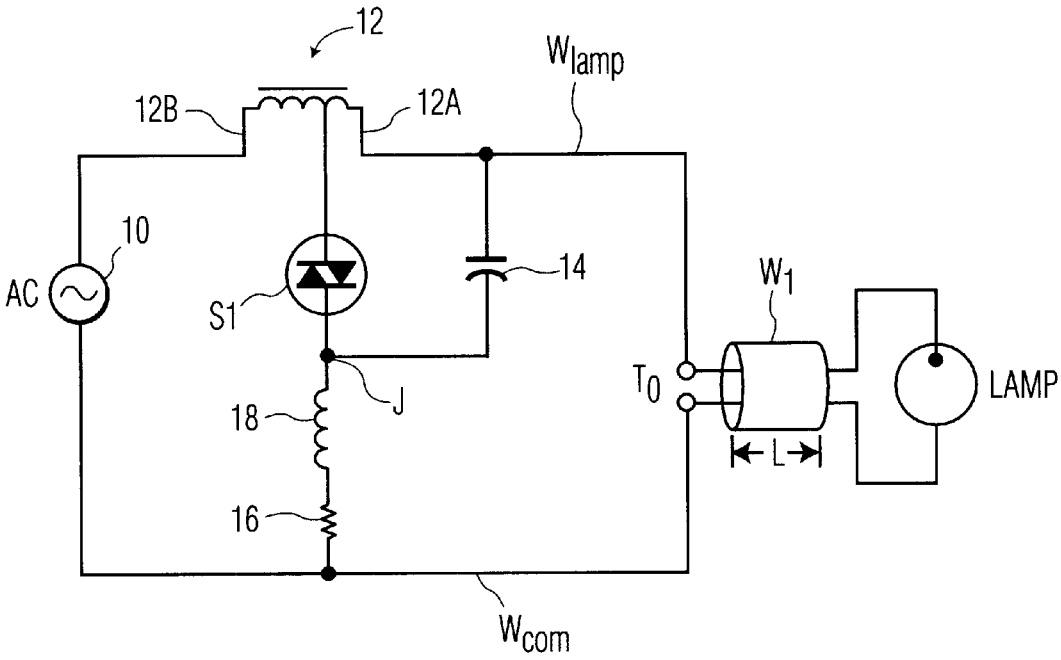
FIG. 1 PRIOR ART
FIG. 1 is a schematic drawing of a prior art electromagnetic ballast.

In order to facilitate understanding of the present invention, a prior art electro-magnetic ballast is briefly discussed. Such a prior art ballast is shown in FIG. 1. The ballast includes an AC source 10 and an autotransformer 12 electrically connected in a first series loop with a gaseous discharge lamp via a lamp supply conductor $W_{lamp}$, a common conductor $W_{com}$, and a length L of two-conductor cable $W_1$, extending from output terminals $T_0$ of the ballast to the lamp. The autotransformer 12 is formed from a ballast inductor having a primary winding 12A and a secondary winding 12B. A bi-directional voltage-sensitive switch S1 is electrically connected in a second series loop with a capacitor 14 and the primary winding 12A. In this embodiment, the switch S1 is a sidac. A resistor 16 and an RF blocking coil 18 are electrically connected in series between a junction J (connecting one side of the sidac S1 and the capacitor 14) and the common conductor $W_{com}$.

In operation, during each positive cycle of the AC voltage produced by the source 10, capacitor 14 charges through the path including the autotransformer 12, the resistor 16 and the coil 18. If the lamp has not yet ignited, capacitor 14 charges until its voltage exceeds the breakover threshold of the sidac S1. When the sidac S1 breaks over, the voltage on the capacitor 14 is applied across primary winding 12A, resulting in the production of a stepped-up voltage across secondary winding 12B and causing a high-voltage ignition pulse to be produced at the output terminals $T_0$. This pulse is applied to the lamp via the cable $W_1$.

When the current through the sidac S1 approaches zero, the sidac switches off and the capacitor voltage follows that of the AC source until it again exceeds the breakover voltage of the sidac. The resistor 16 forms a timing circuit with capacitor 14. The RC time constant of this circuit determines a phase shift in the charging voltage of the capacitor, relative to the phase of the voltage produced by the AC source 10. Advantageously, this time constant is made such that the breakover voltage occurs near the peak voltage produced by the AC source and such that at least one ignition pulse is produced per half cycle.

During each negative half cycle, the ballast operates in the same manner, but with the current flowing in the opposite direction to produce a high-voltage ignition pulse. The circuit continues to produce ignition pulses until the lamp goes into conduction. When that occurs, the lamp voltage decreases rapidly and stabilizes at a voltage which is too low to permit capacitor 14 to again charge to the breakover voltage of the sidac S1. The ignition pulses then cease and the lamp is maintained in conduction by the operation of the AC source 10 and the autotransformer 12.

The peak voltage of the ignition pulses is determined, to a large degree, by the energy-storage capacities of the autotransformer 12 and the capacitor 14 relative to the value of the parasitic loading capacitance associated with the cable $W_1$. In effect, the autotransformer 12 and the capacitor 14 serve as reactive sources of energy for charging the parasitic capacitance of the cable $W_1$. As previously explained in the foregoing discussion, as the length of cable $W_1$, increases, the value of parasitic capacitance increases as well as the amount of energy needed to charge the parasitic capacitance to the voltage needed to ignite the lamp.

Figure 2:
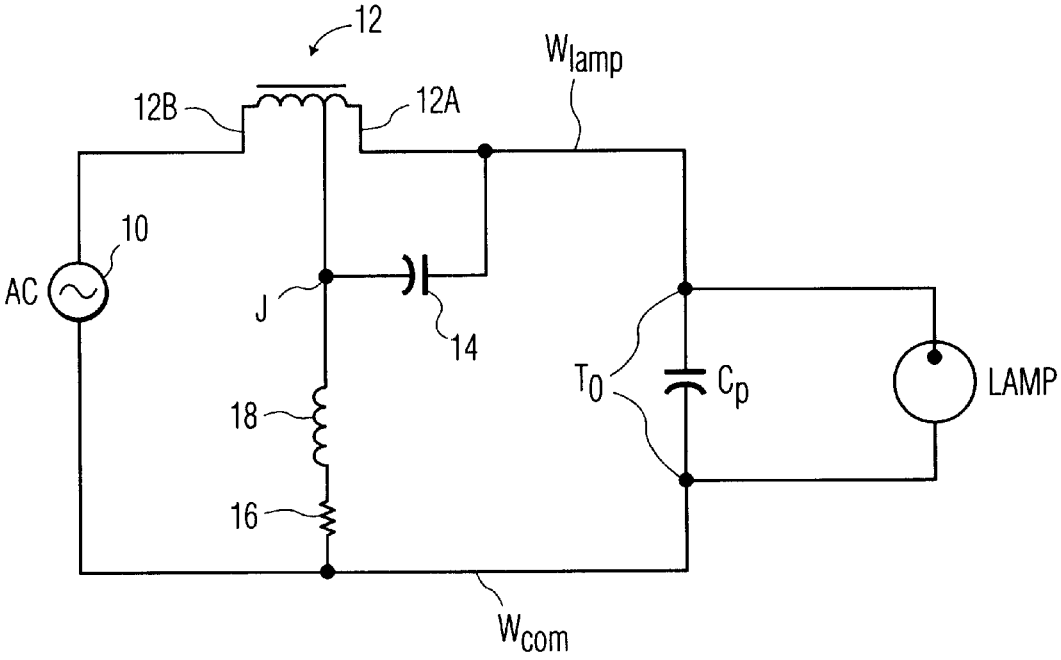
FIG. 2 PRIOR ART
FIG. 2 is a schematic drawing of an equivalent circuit for the circuit arrangement of FIG. 1 at an instant in time.

FIG. 2 represents an equivalent circuit of the circuit shown in FIG. 1 immediately after breakover of the sidac S1. In this equivalent circuit, the conducting sidac is replaced with a conductor and the combined parasitic capacitances associated with the lamp (e.g. those of the cable) are represented by a capacitor $C_p$.

At the instant following breakover of the sidac:

a) The voltage on capacitor 14 is imposed across the primary winding 12A and stepped up to a higher voltage appearing across the secondary winding 12B.

b) The voltages across the primary and secondary windings add to the instantaneous voltage then being produced by the source 10 to apply the peak ignition pulse voltage across the conductors $W_{lamp}$ and $W_{com}$.

c) Capacitor 14 predominately becomes the effective source of energy for charging all parasitic capacitance along the path from the output terminals $T_0$ of the ballast to the lamp, i.e. for charging the capacitance $C_p$.

d) The lamp has not yet ignited and thus can be considered as an open circuit.

In accordance with prior are techniques, the value of the capacitor 14 is made large enough to effect charging of the largest parasitic loading capacitance in the range to a voltage that is greater than the minimum voltage required to ignite the lamp. However, at lower values of parasitic capacitance within this range, the value of capacitor 14 would be too large. As a result, a large-valued capacitor 14 would effect charging of lower values of parasitic capacitance to ignition voltages that are higher than desired (e.g. higher than a maximum permissible ignition voltage for the lamp) Table I list exemplary component values for the circuit in FIG. 1.

TABLE I

Exemplary Components for FIG. 1 Circuit

| Ref # | Description |
|---|---|
| 10 | 277 VRMS source |
| 12 | tapped autotransformer with N turns |
| 12A | 0.1 N turns of primary winding |
| 12B | 0.9 N turns of secondary winding |
| S1 | 230 V sidac |
| 14 | 0.458 mF capacitor |
| 16 | 4 k Ohm, 18 Watt resistor |
| 18 | 45 mH choke |
| $W_1$ | three-conductor, 16 AWG insulated copper cable |

Figure 3:
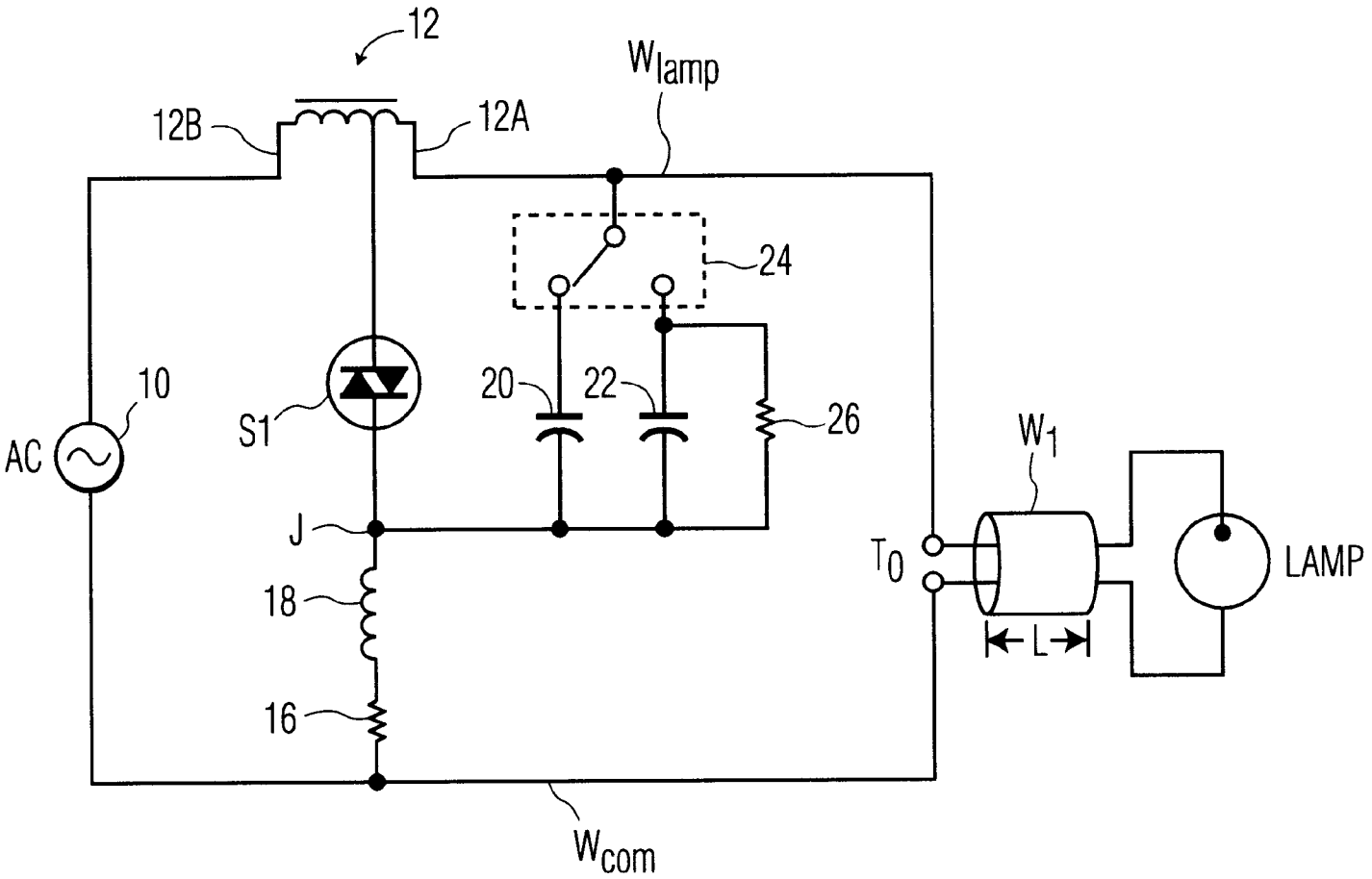
FIG. 3 is a schematic drawing of a circuit arrangement in accordance with a first embodiment of the invention.

Referring to FIG. 3, there is shown an electro-magnetic ballast that incorporates the present invention. The ballast includes AC source 10, autotransformer 12 and a bi-directional voltage-sensitive switch S1 which have been previously shown in FIG. 1 and described in foregoing discussion. These components have the same purpose and function in the same manner as previously described in the foregoing discussion. The autotransformer 12 is formed from a ballast inductor having a primary winding 12A and a secondary winding 12B. In this embodiment, the switch S1 is a sidac. Similar to the prior art circuit arrangement of FIG. 1, AC source 10, autotransformer 12 are electrically connected in a first series loop with a gaseous discharge lamp via a lamp supply conductor $W_{lamp}$, a common conductor $W_{com}$, and a length L of two-conductor cable $W_1$ extending from output terminals $T_0$ of the ballast to the lamp. The ballast has a first state of operation wherein switch S1 is electrically connected in a second series loop with capacitor 20 and the primary winding 12A and a second state of operation wherein switch S1 is electrically connected in a second series loop with capacitor 22 and the primary winding 12A. Resistor 26 is in parallel with capacitor 22 and functions as a discharge resistor.

Device 24 allows for the ballast to be configured in either the first state of operation or the second state of operation. Device 24 can be configured as a manual or electronic switch that can be operated by a user or customer. Device 24 also can be configured as a connector that is internal to the ballast and comprises a first pair of electrical contacts and a second set of electrical contacts. Each electrical contact of the first pair is electrically connected to a corresponding electrical contact of the second pair. One end of capacitor 20 is connected to one of the contacts of the second pair and one end of capacitor 22 is connected to the other contact to the second pair. A wire or other electrical conduit has one end thereof connected to the conductor $W_{lamp}$ and another end removably connected to either one of the contacts of the first pair, depending upon whether the first or second states of operation are desired.

Resistor 16 and an RF blocking coil 18 are electrically connected in series between a junction J and the common conductor $W_{com}$ as previously described in the foregoing discussion pertaining to the prior art circuit arrangement of FIG. 1. Resistor 16 and coil 18 have the same purpose and function in the same manner as described in the foregoing description. In accordance with the present invention, the ballast is configured in the first state of operation when the length L of cable W1 is within a first predetermined range of cable lengths, and is configured in the second state of operation when the length L of cable W1 is within a second predetermined range of cable lengths. Each predetermined range of cable lengths has a minimum length value and a maximum length value. The minimum length value of the second predetermined range is greater than the maximum length value of the first predetermined range of cable lengths. Each range of cable lengths has a corresponding range of parasitic loading capacitances.

Capacitor 22 has a capacitance that is greater than the capacitance of capacitor 20. Capacitor 20 is switched into the circuit when the length of the cable W1 is within the first predetermined range. Capacitor 20 is switched out of the circuit and capacitor 22 is switched into the circuit when the length L of cable W1 is within the second predetermined range of cable lengths. At no time are capacitors 20 and 22 simultaneously in the circuit. Capacitor 20 has a capacitance that enables the production of an ignition voltage pulse that has a sufficient amplitude to load the parasitic capacitance of the cable, when its length is in the first range, and deliver the required ignition voltage pulse to the lamp without exceeding a permissible maximum voltage.

Typically, the length L of cable W1 can range from 0 to 50 feet, depending on the installation of the lamp. Cables having lengths between about 0 and 50 feet typically have parasitic capacitance within a range of 0 to 1500 pf. In some situations, the length L of cable W1 may exceed 50 feet. However, for purposes of describing the invention and to facilitate understanding of the invention, the aforementioned range of cable lengths has been subdivided into two ranges: a first range wherein cable length L is between about 0 and 25 feet, and a second range wherein the cable length exceeds 25 feet but does not exceed 50 feet. Thus, capacitor 20 is switched into the igniter circuit when the cable length L is between about 0 and 25 feet, and capacitor 22 is switched into the igniter circuit when the cable length L exceeds 25 feet but does not exceed 50 feet. Thus, the voltage pulse actually delivered to the lamp regardless of cable length L will meet ANSI or other manufacturers' specifications.

Table II list exemplary component values for the circuit in FIG. 3.

TABLE II

Exemplary Components for FIG. 3 Circuit

| Ref # | Description |
|---|---|
| 10 | 277 VRMS source |
| 12 | tapped autotransformer with N turns |
| 12A | 0.1 N turns of primary winding |
| 12B | 0.9 N turns of secondary winding |
| S1 | 230 V sidac (or 240–265 V sidac) |
| 20 | 0.12 mF capacitor (400 volts, Type J) |
| 22 | 0.22 mF capacitor (400 volts, Type J) |
| 26 | 470 k Ohm, 18 Watt resistor |
| 16 | 4 k Ohm, 18 Watt resistor |
| 18 | 45 mH choke |
| $W_1$ | three-conductor, 16 AWG insulated copper cable |

The peak voltage of the ignition voltage pulses is determined primarily by the energy-storage capacities of the transformer 12 and either capacitor 20 or capacitor 22 relative to the value of the parasitic loading capacitance associated with the cable W1. It is these reactive components which collectively serve as the energy sources for charging the parasitic capacitance and control the peak pulse voltage that is delivered to the lamp L over a chosen range of values of parasitic capacitance associated with cable W1.

Preferably, capacitor 20 has a capacitance that: (i) is greater than the sum of the capacitance of the cable W1 as well as all other capacitance in the load circuit when the cable length is within the first predetermined range of cable lengths so as to make the parasitic loading capacitance of cable W1 negligible, and (ii) does not allow the production of an ignition voltage pulse that exceeds ANSI specifications. Similarly, the capacitance of capacitor 22 is preferably greater than the sum of the capacitance of the cable W1 as well as all other capacitance in the load circuit when the cable length is within the second predetermined range of cable lengths so as to make the parasitic loading capacitance of cable W1 negligible.

The circuit of FIG. 3 was designed to ignite and power a metal halide lamp requiring a minimum ignition voltage of 3 kV, but having a maximum allowable ignition voltage of 4 kV, over a cable $W_1$ which was the main source of parasitic loading capacitance.

Figure 3A:
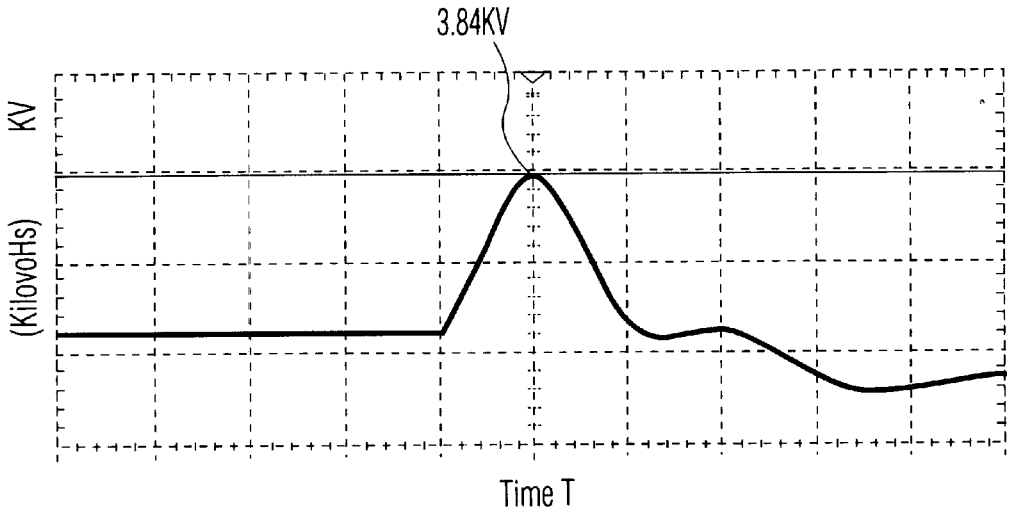
FIGS. 3A and 3B are waveform diagrams of voltage pulses produced by the present invention for different lengths of cable.
Figure 3B:
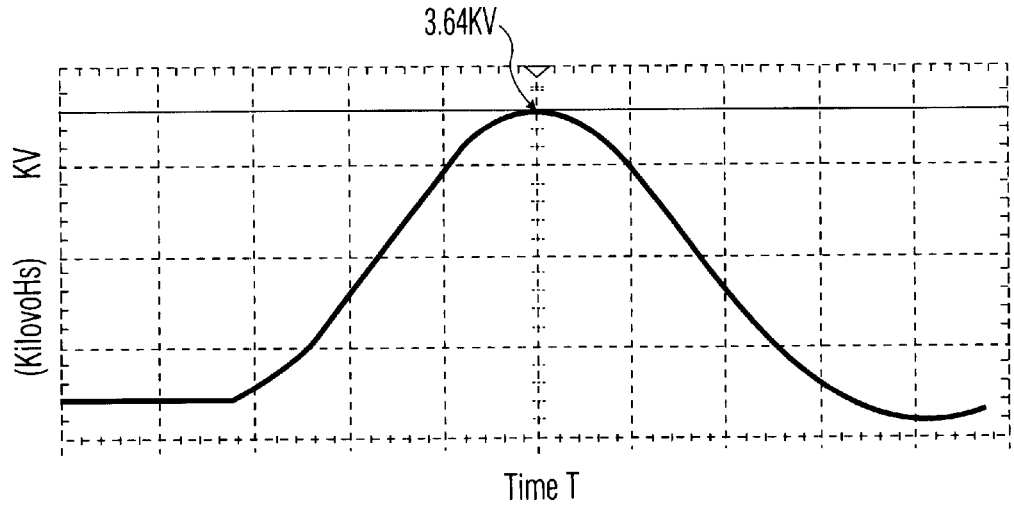

FIGS. 3A and 3B show an oscilloscope display that shows voltage pulse waveforms produced by the circuit of FIG. 3 when the circuit was incorporated into CWA ballast model no. 71A5283 manufactured by the Advanced Transformer Division of Philips North American Corporation. A cable of a particular length was used to measure each waveform. However, a lamp was not connected to the end of the cable thereby providing open circuit conditions. Specifically, FIG. 3A shows a voltage pulse produced by the circuit of FIG. 3 when the circuit was configured in the first state of operation and when the cable length was 2 feet. The peak voltage is 3.84 kilovolts which complies with ANSI specifications. FIG. 3B shows a voltage pulse produced by the circuit of FIG. 3 when the circuit was configured in the second state of operation and when the cable length was 50 feet. The peak voltage is 3.64 kilovolts which complies with ANSI specifications. Furthermore, peak voltage measured for the 50 foot cable decreased by only 0.20 kilovolts or 5.2% when compared to the peak voltage for the 2 foot cable.

Thus, the values of the resistance, inductance and capacitance of resistor 16, coil 18 and capacitor 20, respectively, maintain the ignition voltage pulse within ANSI specifications for short range applications, i.e. the cable length is within the first range of cable lengths discussed in the foregoing discussion. Similarly, the resistance, inductance and capacitance of resistor 16, coil 18 and capacitor 22, respectively, maintain the ignition voltage pulse within ANSI specifications for long range applications, i.e. the cable length is within the second range of cable lengths discussed in the foregoing discussion.

In an alternate embodiment, the igniter circuitry shown in FIG. 3 can be modified to use a pair of capacitors that can be configured into or out of a parallel circuit. In such a configuration, when the ballast has the first state of operation, one of the capacitors is in the circuit and generally has the same capacitance as capacitor 20. When the ballast has the second state of operation, both capacitors are in parallel thereby increasing the equivalent capacitance to a capacitance that is generally the same as the capacitance of capacitor 22.

Figure 4:
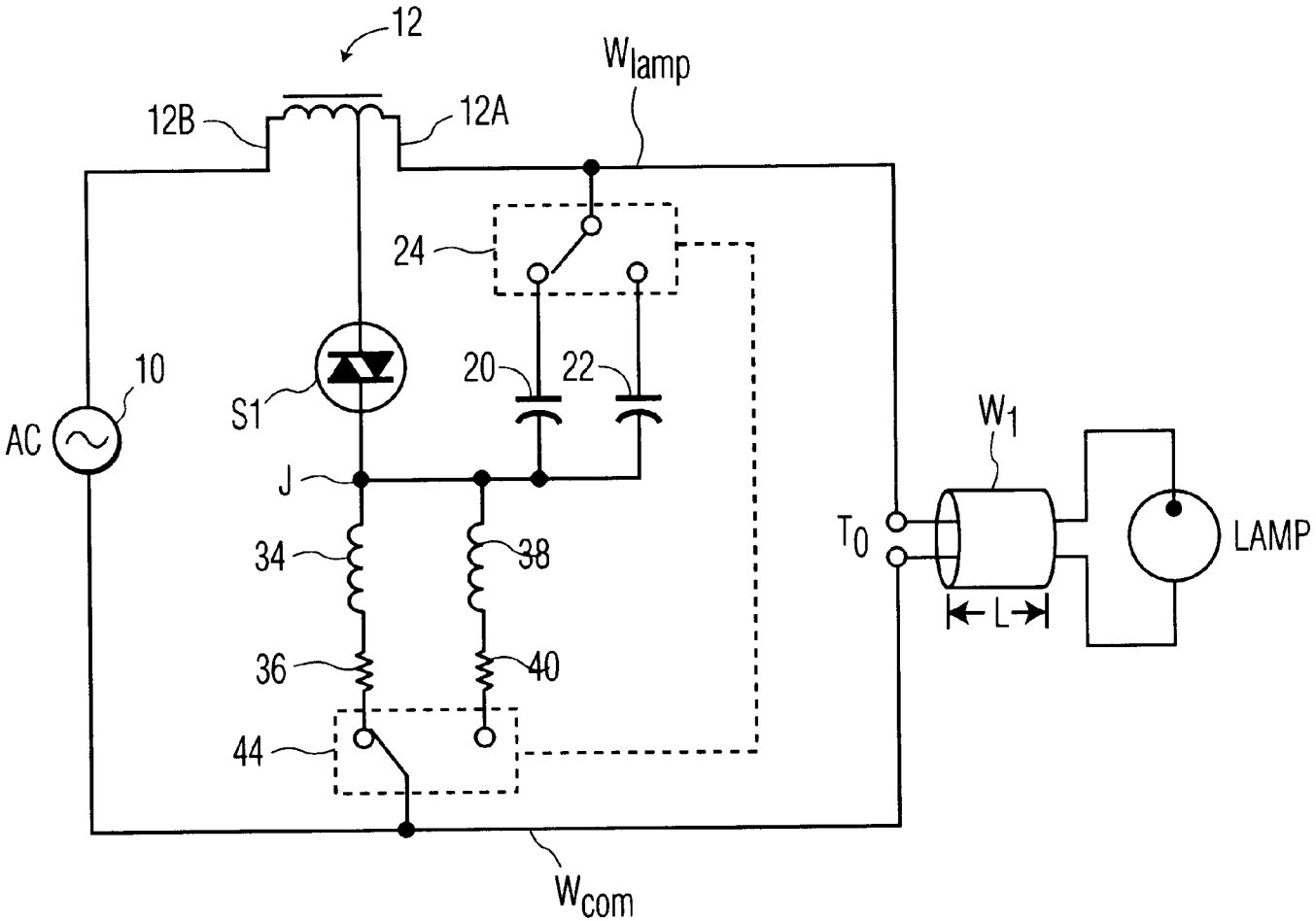
FIG. 4 is a schematic drawing of a circuit arrangement in accordance with a second embodiment of the invention.

Referring to FIG. 4, there is shown an electro-magnetic ballast that incorporates a second embodiment of the present invention. The ballast includes AC source 10, autotransformer 12 and a bi-directional voltage-sensitive switch S1 which have been previously shown in FIG. 3 and described in foregoing discussion. The autotransformer 12 is formed from a ballast inductor having a primary winding 12A and a secondary winding 12B. In this embodiment, the switch S1 is a sidac. Similar to the circuit arrangement of FIG. 3, AC source 10 and autotransformer 12 are electrically connected in a first series loop with a gaseous discharge lamp via a lamp supply conductor $W_{lamp}$, a common conductor $W_{com}$, and a length L of two-conductor cable $W_1$ extending from output terminals $T_0$ of the ballast to the lamp. The ballast has a first state of operation wherein switch S1 is electrically connected in a second series loop with capacitor 30 and the primary winding 12A and wherein RF blocking coil 34 and resistor 36 are in circuit and connected between junction J and common conductor $W_{com}$. The ballast also has a second state wherein switch S1 is electrically connected in a second series loop with capacitor 32 and the primary winding 12A, and wherein RF blocking coil 38 and resistor 40 are in circuit and connected between junction J and common conductor $W_{com}$.

Devices 42 and 44 allow for the ballast to be configured in either the first state of operation or the second state of operation. Each devices 42 and 44 can be configured in the same manner as device 24 described in the foregoing discussion. In one embodiment, devices 42 and 44 are operationally linked together such that the devices 42 and 44 are in synchronization and controlled simultaneously in order to configure the ballast in either the first or second states of operation. In accordance with the present invention, and in a manner similar to the circuit of FIG. 3, the ballast is configured in the first state of operation when the length L of cable W1 is within a first predetermined range of cable lengths, and is configured in the second state of operation when the length L of cable W1 is within a second predetermined range of cable lengths. Each predetermined range of cable lengths has a minimum length value and a maximum length value. The minimum length value of the second predetermined range is greater than the maximum length value of the first predetermined range of cable lengths. As described in the foregoing description, each range of cable lengths has a corresponding range of parasitic loading capacitances.

Capacitor 30, coil 34 and resistor 36 are switched into the circuit when the length of the cable W1 is within the first predetermined range. Capacitor 30, coil 34 and resistor 36 are switched out of the circuit and capacitor 32, coil 38 and resistor 40 are switched into the circuit when the length L of cable W1 is within the second predetermined range of cable lengths. The capacitance, inductance and resistance of capacitor 30, coil 34 and resistor 36, respectively, cooperate to provide a voltage pulse that has a sufficient amplitude to load the parasitic capacitance of the cable, when its length is in the first range, and deliver the required voltage to the lamp without exceeding a permissible maximum voltage. Capacitor 32 has a capacitance that is greater than the capacitance of capacitor 30. The capacitance, inductance and resistance of capacitor 32, coil 38 and resistor 40, respectively, cooperate to produce a voltage pulse of sufficient amplitude to load the parasitic capacitance of the cable W1, when its length is in the second range of lengths, and yet deliver at least the minimum required voltage pulse to the lamp.

Preferably, capacitor 30 has a capacitance that: (i) is greater than the sum of the capacitance of the cable W1 as well as all other capacitance in the load circuit when the cable length is within the first predetermined range of cable lengths so as to make the parasitic loading capacitance of cable W1 negligible, and (ii) does not allow the production of an ignition voltage pulse that exceeds ANSI specifications. Similarly, the capacitance of capacitor 32 is preferably greater than the sum of the capacitance of the cable W1 as well as all other capacitance in the load circuit when the cable length is within the second predetermined range of cable lengths so as to make the parasitic loading capacitance of cable W1 negligible.

Figure 5:
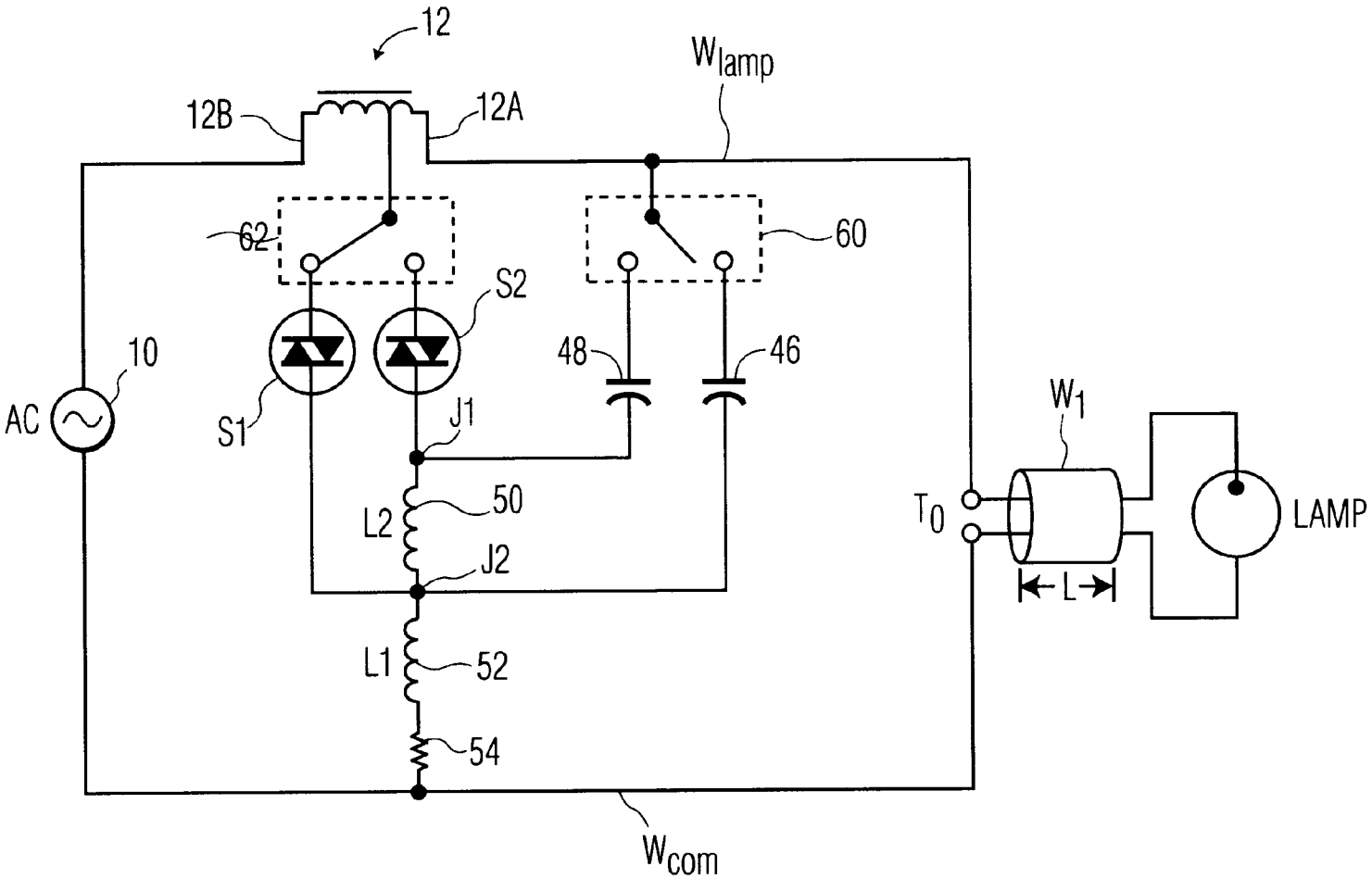
FIG. 5 is a schematic drawing of a circuit arrangement in accordance with a third embodiment of the invention.

Referring to FIG. 5, there is shown an electromagnetic ballast that incorporates a second embodiment of the present invention. The ballast includes AC source 10 and autotransformer 12 which have been previously shown in FIG. 3 and described in foregoing discussion. These components have the same purpose and function in the same manner as previously described in the foregoing discussion. The autotransformer 12 is formed from a ballast inductor having a primary winding 12A and a secondary winding 12B. The ballast also includes and a bi-directional voltage-sensitive switch S1, as described in the foregoing description, as well as an additional a bi-directional voltage-sensitive switch S2. In this embodiment, the switches S1 and S2 are sidacs. Similar to the prior art circuit arrangement of FIG. 3, AC source 10 and autotransformer 12 are electrically connected in a first series loop with a gaseous discharge lamp via a lamp supply conductor $W_{lamp}$, a common conductor $W_{com}$, and a length L of two-conductor cable $W_1$ extending from output terminals $T_0$ of the ballast to the lamp. The ballast includes capacitors 46 and 48, RF blocking coils 50 and 52, and resistor 54. The capacitance of capacitor 48 is greater than the capacitance of capacitor 46. The junction of switch S2 and capacitor 48 is designated by J1. The junction of capacitor 46, switch S1, and coil 52 is designated by J2.

The ballast has a first state of operation wherein switch S1 is electrically connected in a second series loop with capacitor 46 and the primary winding 12A and wherein RF blocking coil 52 and resistor 54 form a series circuit that is connected between junction J2 and common conductor $W_{com}$. The ballast also has a second state of operation wherein capacitor 46 and switch S1 are dropped out of the circuit, switch S2 is electrically connected in a second series loop with capacitor 48 and the primary winding 12A, and RF blocking coils 50 and 52 and resistor 54 are in circuit and connected between junction J2 and common conductor $W_{com}$.

Devices 60 and 62 allow for the ballast to be configured in either the first state or the second state. Each devices 60 and 62 can be configured in the same manner as device 24 described in the foregoing discussion.

In accordance with the present invention, and in a manner similar to the circuits of FIGS. 3 and 4, the ballast is configured in the first state of operation when the length L of cable W1 is within a first predetermined range of cable lengths, and in the second state of operation when the length L of cable W1 is within a second predetermined range of cable lengths. Each predetermined range of cable lengths has a minimum length value and a maximum length value. The minimum length value of the second predetermined range is greater than the maximum length value of the first predetermined range of cable lengths. As described in the foregoing description, each range of cable lengths has a corresponding range of parasitic loading capacitances.

Capacitor 46 and switch S1 are switched into the circuit in the first state of operation, i.e. when the length of the cable W1 is within the first predetermined range. The capacitance, inductance and resistance of capacitor 46, coil 52 and resistor 54, respectively, cooperate to provide a voltage pulse that has a sufficient amplitude to load the parasitic capacitance of the cable, when its length is in the first range, and deliver the required voltage to the lamp without exceeding a permissible maximum voltage. When the ballast is configured in the second state of operation, i.e. the length L of cable W1 is within the second predetermined range of cable lengths, capacitor 46 and switch S1 are switched out of the circuit and capacitor 48 and switch S2 are switched into circuit. The capacitance, inductance and resistance of capacitor 48, coils 50, 52 and resistor 54, respectively, cooperate to produce a voltage pulse of sufficient amplitude to load the parasitic capacitance of the cable W1, when its length is in the second range of lengths, and yet deliver at least the minimum required voltage pulse to the lamp.

Preferably, capacitor 46 has a capacitance that: (i) is greater than the sum of the capacitance of the cable W1 as well as all other capacitance in the load circuit when the cable length is within the first predetermined range of cable lengths so as to make the parasitic loading capacitance of cable W1 negligible, and (ii) does not allow the production of an ignition voltage pulse that exceeds ANSI specifications. Similarly, the capacitance of capacitor 48 is preferably greater than the sum of the capacitance of the cable W1 as well as all other capacitance in the load circuit when the cable length is within the second predetermined range of cable lengths so as to make the parasitic loading capacitance of cable W1 negligible.

Thus, the igniter circuit of the present invention ensures that the peak pulse voltage actually delivered to the lamp, at any value of loading capacitance due to the cable W1, is at least equal to the minimum voltage needed to ignite the lamp but no greater than the maximum permissible ignition voltage that may be applied to the lamp. These voltages are determined from manufacturers— or ANSI specifications for the specific type or types of lamps for which the circuitry is designed.

Figure 6:
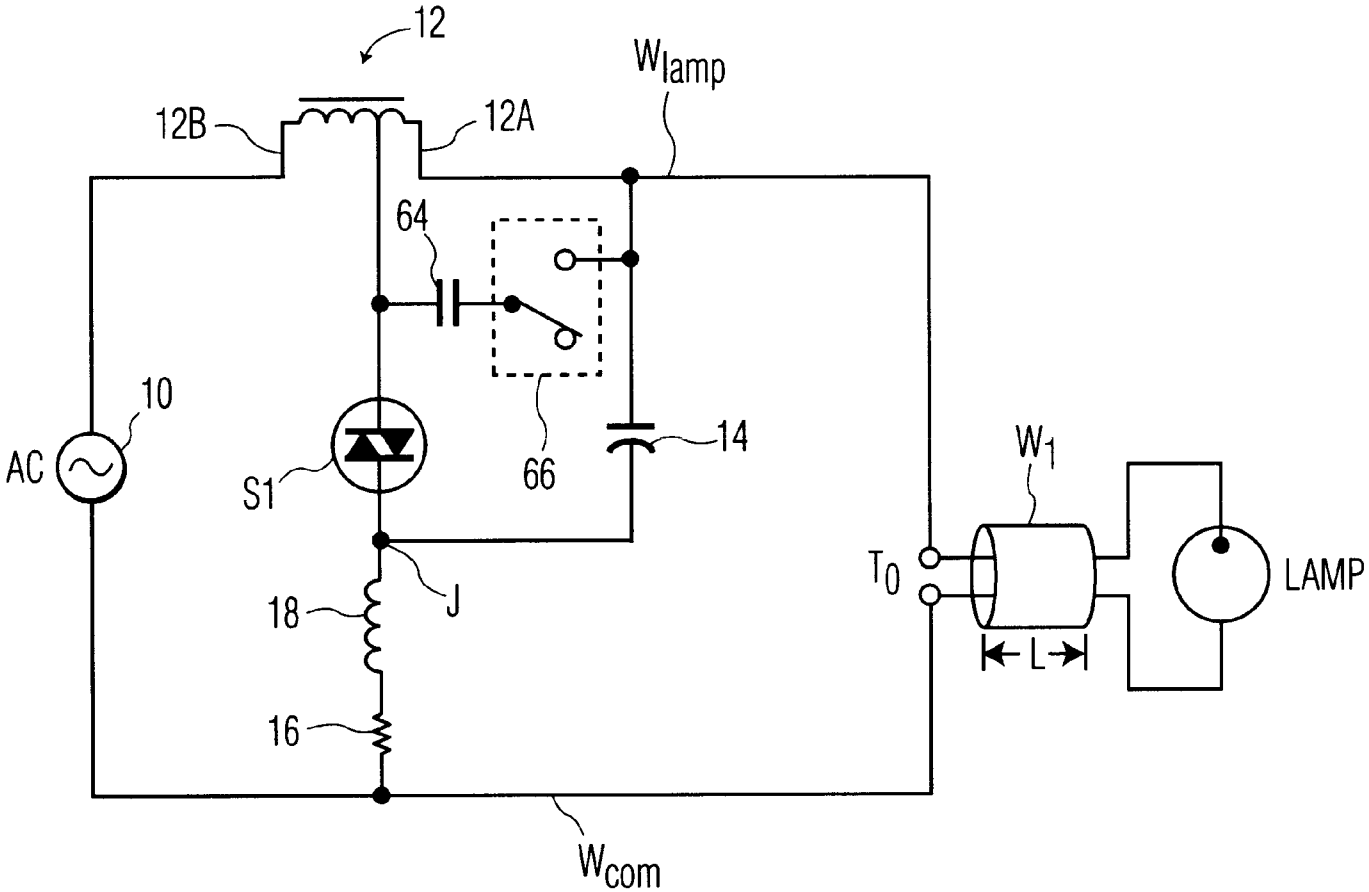
FIG. 6 is a schematic drawing of a circuit arrangement in accordance with a fourth embodiment of the invention.

Referring to FIG. 6, there is shown an electromagnetic ballast that incorporates a fourth embodiment of the present invention. The ballast includes AC source 10, autotransformer 12, a bi-directional voltage-sensitive switch S1, capacitor 14, resistor 16 and RF blocking coil 18 which have been previously shown in FIG. 1 and described in foregoing discussion. In accordance with the present invention, the ballast further includes capacitor 64 and device 66. Capacitor 64 has one end that is connected to one end of switch S1 and a second end that is inputted into device 66. Device 66 has first state of operation that effects isolation of the second end of capacitor 64 from switch S1 and a second state of operation that effects connection of the second end of capacitor 64 to capacitor 14. Thus, device 66 can switch capacitor 64 either into or out of the circuit. Device 66 may be configured to have the same configuration of device 24 and any alternate configurations thereof that were discussed in the foregoing description. In an alternate embodiment, the circuitry is altered such that one end of capacitor 64 is connected to one end of capacitor 14 and the second end of capacitor 64 is inputted into device 66 which either connects or isolates the second end of capacitor 64 to or from, respectively, from the switch S1. Similar to the embodiments discussed above, the ballast of FIG. 6 has a first state of operation when cable W1 has a length L in the first predetermined range of cable lengths which was defined in the foregoing discussion and a second state of operation when the cable W1 has a length L that is within the second predetermined range of cable lengths that was defined in the foregoing discussion. Device 66 configures the ballast in either the first state of operation or the second state of operation. When the ballast is in the first state of operation, capacitor 64 is switched out of the circuit and a first energy source is formed which comprises capacitor 14 and which produces the ignition voltage pulse that is inputted into cable W1. When the ballast is in the second state of operation, capacitor 64 is switched into the circuit and a second energy source is formed which comprises capacitors 14 and 64 and which produces the ignition voltage pulse that is inputted into cable W1.

Capacitor 64 adjusts the resonance frequency of the secondary circuit of the autotransformer 12 for shaping the ignition pulse so that the ignition pulse specification of the lamp is met throughout the full range of parasitic loading capacitances resulting from a cable W1 having a length within a predetermined range lengths of the cable W1. Advantageously, the capacitor 64 promotes reliable lamp ignition. The value of the capacitor 64 is selected both to shape the ignition pulse to the lamp when the length L of cable W1 is within the second predetermined range of cable lengths described in the foregoing discussion as well as to somewhat stabilize the total capacitance seen by the ignition circuit. Preferably, the value of the capacitor 64 is greater than the sum of the capacitance of the cable WI as well as all other capacitance in the load circuit. Thus, the capacitance of capacitor 64 is such that it makes the parasitic loading capacitance of cable W1 negligible. Table III list exemplary component values for the circuit in FIG. 6.

TABLE III

Exemplary Components for FIG. 3 Circuit

| Ref # | Description |
|---|---|
| 10 | 277 VRMS source |
| 12 | tapped autotransformer with N turns |
| 12A | 0.1 N turns of primary winding |
| 12B | 0.9 N turns of secondary winding |
| S1 | 230 V sidac (or 240–265 V sidac) |
| 14 | 0.30 mF capacitor |
| 64 | 0.22 mF capacitor |
| 16 | 4 k Ohm, 18 Watt resistor |
| 18 | 45 mH choke |
| $W_1$ | three-conductor, 16 AWG insulated copper cable |

The peak voltage of the ignition voltage pulses is determined primarily by the energy-storage capacities of the transformer 12 and either (i) capacitor 14, or (ii) capacitor 14 and capacitor 64 relative to the value of the parasitic loading capacitance associated with the cable W1. It is these reactive components which collectively serve as the energy sources for charging the parasitic capacitance and control the peak pulse voltage that is delivered to the lamp L over a chosen range of values of parasitic capacitance associated with cable W1.

The circuit of FIG.6 was tested with an open lamp load, which essentially represents operation into a clod lamp prior to its entering into a glow stage. When the cable W1 length L was about 0 feet, the ballast was configured in the first state of operation via device 66 and produced an ignition voltage pulse having a peak voltage of about 3.6 kilovolts. When the cable W1 length L was about 50 feet, the ballast was configured in the second state of operation via device 66 and produced an ignition voltage pulse having a peak voltage of about 3.1 kilovolts. Thus, the signal degradation was only 500 volts (or 14%) when the length L of cable W1 was 50 feet as compared to signal degradation of about 2.2 kilovolts achieved by prior art circuitry. The signal degradation of just 500 volts is not critical to the operation of the lamp. Thus, the ballast of FIG. 6 can deliver an ignition pulse that is within specification for various lengths of cables.

The present invention provides many advantages and benefits. Specifically, the present invention allows for the manufacture of a single electromagnetic ballast that comprises both short range and long range igniter circuitry. The short range and long range igniter circuitry share other common ballast components thereby reducing the per-unit-cost of the ballast. Furthermore, the present invention provides the capability for customers or end users to easily configure the ballast so as to utilize either the long range or short range igniter circuitry. Additionally, product inventory is simplified and streamlined since it will not be necessary to maintain an inventory containing separate long range and short range ballasts. Another important advantage of the present invention is that the igniter voltage pulse will never exceed the manufacturers' or ANSI specification for short range applications. Thus, the operational life of the lamp and associated components may be extended.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, what is claimed is:

1. Circuitry for powering a gaseous discharge lamp that has a required minimum ignition voltage and a permissible maximum ignition voltage, the circuitry comprising an output configured for connection to a cable through which ignition voltage pulses are delivered to the lamp, wherein the cable has a predetermined parasitic loading capacitance that depends upon the length of the cable and wherein said predetermined parasitic loading capacitance is within a range of parasitic loading capacitances defined by a predetermined minimum capacitance and a predetermined maximum capacitance, said circuitry further comprising a source of ignition pulses including an energy source capable of outputting an ignition voltage into a cable that has the predetermined maximum parasitic loading capacitance and charging said predetermined maximum parasitic loading capacitance to at least the required minimum ignition voltage of the lamp, the source of ignition pulses comprising a first energy source and a second energy source, the source of ignition pulses having a first state of operation, wherein the first energy source charges the parasitic loading capacitance of the cable to a voltage that does not exceed the permissible maximum voltage of the lamp when the parasitic loading capacitance of the cable is within a first predetermined range of capacitances and a second state of operation wherein the second energy source charges the parasitic loading capacitance of the cable to at least the required minimum ignition voltage of the lamp when the parasitic capacitance of the cable is within a second predetermined range of capacitances, wherein each capacitance of the second range is larger than every capacitance of the first range.

2. The circuitry according to claim 1 wherein the first energy source comprises a capacitive energy source.

3. The circuitry according to claim 1 wherein the second energy source comprises a capacitive energy source.

4. The circuitry according to claim 1 wherein each of the first and second energy sources comprises a capacitive energy source.

5. The circuitry according to claim 4 wherein the capacitive energy source of the first energy source has a first capacitance and the capacitive energy source of the second energy source has a second capacitance that is greater than the first capacitance.

6. The circuitry according to claim 1 wherein each of the first and second energy sources comprises a reactive energy source.

7. The circuitry according to claim 1 means for selecting either the first state of operation or the second state of operation.

8. Circuitry for powering a gaseous discharge lamp that has a required minimum ignition voltage and a permissible maximum ignition voltage, the circuitry comprising an output configured for connection to a cable through which ignition voltage pulses are delivered to the lamp, wherein the cable has a predetermined parasitic loading capacitance that depends upon the length of the cable, said circuitry further comprising a source of ignition pulses including an energy source capable of outputting an ignition voltage into a cable, the source of ignition pulses comprising a first energy source and a second energy source, the source of ignition pulses having a first state of operation when the length of the cable is within a first predetermined range of lengths, wherein the first energy source charges the parasitic loading capacitance of the cable to a voltage that does not exceed the permissible maximum voltage of the lamp, and a second state of operation when the length of the cable is within a second predetermined range of lengths, wherein the second energy source charges the parasitic loading capacitance of the cable to at least the required minimum ignition voltage of the lamp, each length in the second predetermined range of lengths being greater than every length in the first predetermined range of lengths.

9. The circuitry according to claim 8 wherein each of the first and second energy sources comprises a capacitive energy source.

10. The circuitry according to claim 9 wherein the capacitive energy source of the first energy source has a first capacitance and the capacitive energy source of the second energy source has a second capacitance that is greater than the first capacitance.

11. The circuitry according to claim 8 wherein each of the first and second energy sources comprises a reactive energy source.

12. The circuitry according to claim 8 further comprising means for selecting between the first state of operation or the second state of operation.

13. Circuitry for powering a gaseous discharge lamp that has a required minimum ignition voltage and a permissible maximum ignition voltage, the circuitry comprising an output configured for connection to a cable through which ignition voltage pulses are delivered to the lamp, wherein the cable has a predetermined parasitic loading capacitance that depends upon the length of the cable and wherein said predetermined parasitic loading capacitance is within a range of parasitic loading capacitances defined by a predetermined minimum capacitance and a predetermined maximum capacitance, said circuitry further comprising a source of ignition pulses including an energy source capable of outputting an ignition voltage into a cable that has the predetermined maximum parasitic loading capacitance and charging said predetermined maximum parasitic loading capacitance to at least the required minimum ignition voltage of the lamp, the source of ignition pulses comprising a first capacitive energy source and a second capacitive energy source, the source of ignition pulses having a first state of operation wherein the first capacitive energy source charges the parasitic loading capacitance of the cable to a voltage that does not exceed the permissible maximum voltage of the lamp when the parasitic loading capacitance of the cable is within a first predetermined range of capacitances, and a second state of operation wherein the second capacitive energy source charges the parasitic loading capacitance of the cable to at least the required minimum ignition voltage of the lamp when the parasitic capacitance of the cable is within a second predetermined range of capacitances, wherein each capacitance of the second range is larger than every capacitance of the first range, the circuitry farther comprising means for configuring the circuitry in either the first state of operation or the second state of operation.

* * * * *